United States Patent [19]

Kobayashi et al.

[11] Patent Number: 4,681,077

[45] Date of Patent: Jul. 21, 1987

[54] AIR-FUEL RATIO CONTROLLING METHOD AND APPARATUS FOR AN INTERNAL COMBUSTION ENGINE

[75] Inventors: Haruhiko Kobayashi, Ibaraki; Tadahiko Otani, Katsuta, both of Japan

[73] Assignee: Hitachi, Ltd., Tokyo, Japan

[21] Appl. No.: 692,572

[22] Filed: Jan. 18, 1985

[30] Foreign Application Priority Data

Jan. 20, 1984 [JP] Japan ..... 59-7202

[51] Int. Cl.[4] ..... F02D 41/14

[52] U.S. Cl. ..... 123/489; 123/491

[58] Field of Search ..... 123/440, 489, 589, 491

[56] References Cited

U.S. PATENT DOCUMENTS 4,321,903 3/1982 Kondo et al. ..... 123/440

4,392,471 7/1983 Miyagi et al. ..... 123/440

4,498,445 2/1985 Hasegawa et al. ..... 123/489

4,526,001 7/1985 Burns et al. ..... 123/589

*Primary Examiner*—Andrew M. Dolinar

*Attorney, Agent, or Firm*—Antonelli, Terry & Wands

[57] ABSTRACT

A method and apparatus for controlling an air-fuel ratio for an engine, in which a closed-loop control and an open-loop control are performed selectively in accordance with the operating condition of the engine. The closed-loop control determines an air-fuel ratio of the mixture to be supplied to a combustion chamber on the basis of the oxygen concentration within the exhaust gas. The open-loop control determines an air-fuel ratio of the mixture by modifying the air-fuel ratio determined in the closed-loop control in a manner that the former one is lean by a predetermined ratio than the latter one.

2 Claims, 14 Drawing Figures

FIG. 11
| COOLING WATER TEMPERATURE (°C) | ~ 0 | 0~ 20 | 20~40 | 40~60 | 60~ |
|---|---|---|---|---|---|
| ON-DUTY COMPENSATION FACTER | 0.2 | 0.4 | 0.6 | 0.8 | 1.0 |
FIG. 12
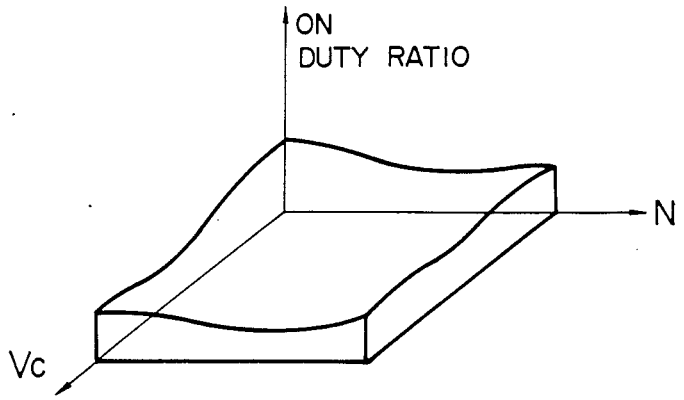
FIG. 13
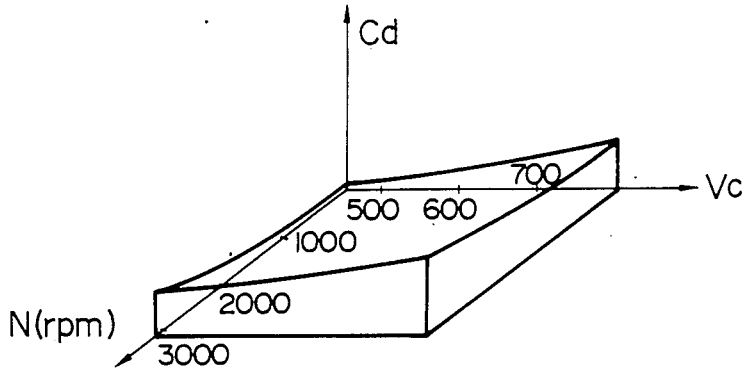

AIR-FUEL RATIO CONTROLLING METHOD AND APPARATUS FOR AN INTERNAL COMBUSTION ENGINE

BACKGROUND OF THE INVENTION

This invention relates to a method and apparatus for microcomputer control of an engine, and, more particularly, to a method and apparatus for controlling an air-fuel ratio to a motor vehicle engine wherein an amount of fuel supplied to the engine is controlled relative to an amount of suction air in the engine.

In a conventional engine controlling method using a microcomputer, various different sensors supply data of operating conditions of engine, on which the basic amount of fuel supplied is determined and controls the carburetor or fuel injector through the actuator. In the air-fuel ratio control in the engine control system, the output signal from the oxygen sensor mounted on the exhaust pipe is used to control the amount of fuel to the engine by the closed loop control mode and thereby to provide a proper air-fuel ratio. In other words, in the conventional engine control system, a three-way catalyst is used to purify the exhaust gas, and the air-fuel ratio of a fuel mixture for purifying at the highest efficiency is controlled to become a stoichiometric air-fuel ratio. The operation of engine at the stoichiometric air-fuel ratio will result in a poor fuel consumption rate and hence uneconomical operation.

Thus, to cope with the recent exhaust gas regulation and improve the rate of fuel consumption of an engine, the air-fuel ratio is made to be lean in accordance with the driving condition of the engine, for example, upon deceleration as is well known.

In this case, the air-fuel ratio is corrected to increase by a predetermined rate relative to a certain fixed air-fuel ratio, or the stoichiometric air-fuel ratio. However, since the characteristics of the fuel system are changed for each engine and undergo secular variation, the stoichiometric air-fuel ratio can not be always obtained and the corected air fuel ratio is not always proper from the standpoint of the fuel consumption rate and exhaust gas purification.

SUMMARY OF THE INVENTION

It is an object of the invention to provide an air-fuel controlling method capable of improving the fuel consumption rate without deteriorating the emission of exhaust gas.

In order to achieve the above object of this invention, the air fuel ratio controlling method of the invention employs switching of the closed-loop control for determining the air-fuel ratio on the basis of the oxygen concentration within the exhaust gas and the open-loop control for the control of engine by the corrected air-fuel ratio which is a certain extent more lean than the air-fuel ratio determined by the closed-loop control, in accordance with the driving condition of the engine.

BRIEF DESCRIPTION OF THE DRAWINGS

FIG. 11 shows a map of an on-duty compensation factor in a warming-up operation, which is stored in a RAM;

FIG. 12 shows a three-dimensional map of the on-duty stored in the RAM;

FIG. 13 shows a three-dimensional map of the on-duty compensation factor in a decelerating operation, which is stored in the RAM.

DETAILED DESCRIPTION

Figure 1:
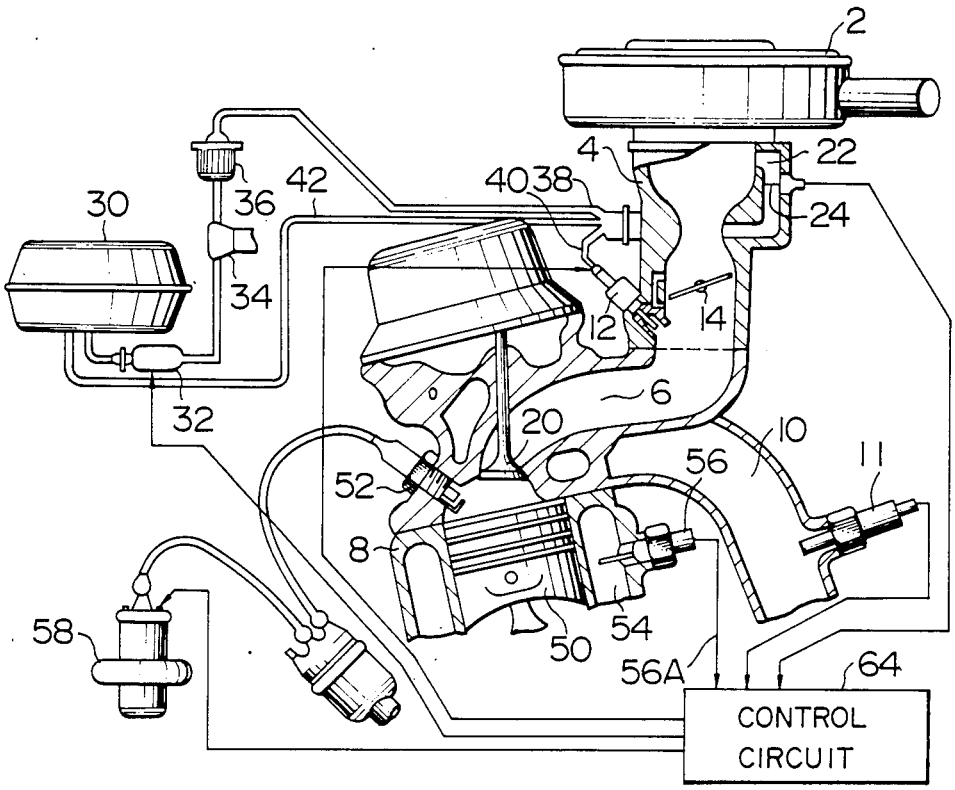
FIG. 1 is a partially schematic cross-sectional view of a fuel injection type engine control system.

Referring now to the drawings wherein like reference numerals are used throughout the various views to designate like parts and, more particularly, to FIG. 1. According to this figure, in an air fuel ratio controlling or engine controlling method of the present invention applied to a fuel injection system, suction air is supplied to a cylinder 8 through an air cleaner 2, a throttle chamber 4, and a suction pipe 6, with gas combusted in the cylinder 8 being discharged from the cylinder 8 to the atmosphere through an exhaust pipe 10. An injector 12 for injecting fuel is provided in the throttle chamber 4, with the fuel injected from the injector 12 being atomized in an air path of the throttle chamber 4 and mixed with the suction air to form a fuel-air mixture which is supplied to a combustion chamber of the cylinder 8 through the suction pipe 6 when a suction valve 20 is opened.

A throttle valve 14 is provided in a vicinity of the putput of the injector 12, with the throttle valve 14 being arranged so as to be mechanically interlocked with an accelerator pedal (not shown) operable by a driver of a motor vehicle.

An air path 22 is provided upstream of the throttle valve 14 of the throttle chamber 4 and an electrical heater 24, constituting a thermal air flow rate meter, is provided in the air path 22 so as to derive from the heater 24 and electric signal which changes in accordance with the air flow velocity determined by the relationship between the air flow velocity and the amount of heat transmission of the heater 24. By being disposed in the air path 22, the heater 24 is protected from the high temperature gas generated in the period of back fire of the cylinder 8 as well as from the pollution by dust or the like in the suction air. The outlet of the air path 22 is opened in the vicinity of the narrowest portion of the venturi and the inlet of the same is opened at the upper stream of the venturi.

Figure 4:
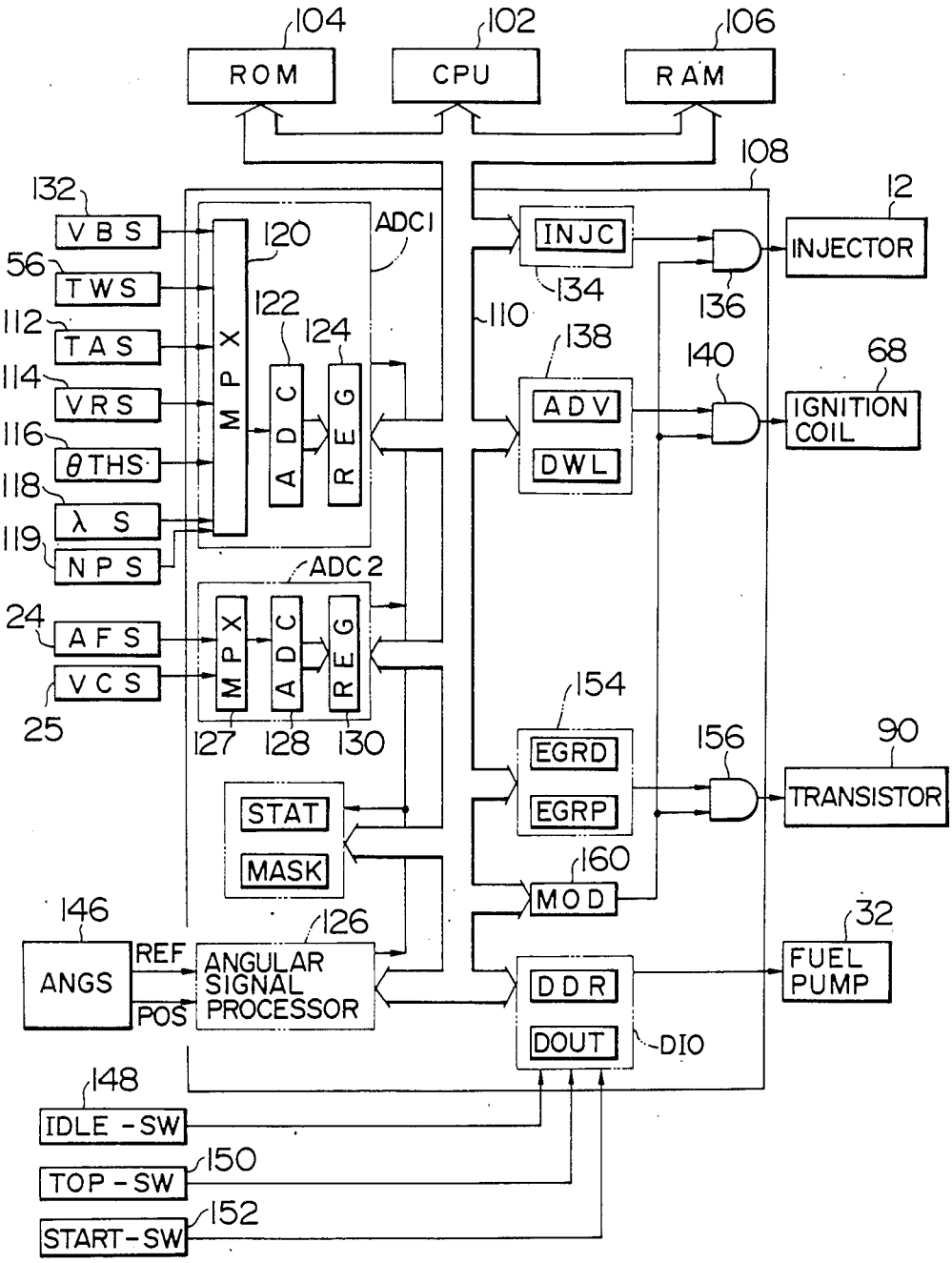
FIG. 4 is a schematic view of a fuel injection type engine control system.

Throttle opening sensors 116 (FIG. 4) are respectively provided in the throttle valve 14 for detecting the opening thereof and the detection signals from the throttle opening sensors 116, are taken into a multiplexer 120 of a first analog-to-digital converter as shown in FIG. 4.

The fuel to be supplied to the injector 12 is first supplied to a fuel pressure regulator 38 from a fuel tank 30 through a fuel pump 32, a fuel damper 34, and a filter 36. Pressurized fuel is supplied from the fuel pressure regulator 38 to the injector 12 through a pipe 40, and fuel is returned from the fuel pressure regulator 38 to the fuel tank 30 through a return pipe 42 so as to constantly maintain the difference between the pressure in the suction pipe 6 into which fuel is injected from the injector 12 and the pressure of the fuel supplied to the injector 12.

The fuel-air mixture sucked through the suction valve 20 is compressed by a piston 50, combusted by a spark produced by an ignition plug 52, and the combustion is converted into kinetic energy. The cylinder 8 is cooled by cooling water 54, with the temperature of the cooling water being measured by a water temperature sensor 56, and the measured value is utilized as an engine temperature. A high voltage is applied from an ignition coil 58 to the ignition plug 52 in agreement with the ignition timing.

A crank angle sensor (not shown) for producing a reference angle signal at a regular interval of predetermined crank angles (for example, 180 degrees) and a position signal at a regular interval of a predetermined unit crank angle (for example, 0.5 degree) in accordance with the rotation of engine, is provided on a crank shaft (not shown).

The output of the crank angle sensor, the output 56A of the water temperature sensor 56, and the electrical signal from the heater 24 are inputted into a control circuit 64, constituted by a microcomputer or the like, so that the injector 12 and the ignition coil 58 are driven by the output of this control circuit 64.

Figure 2:
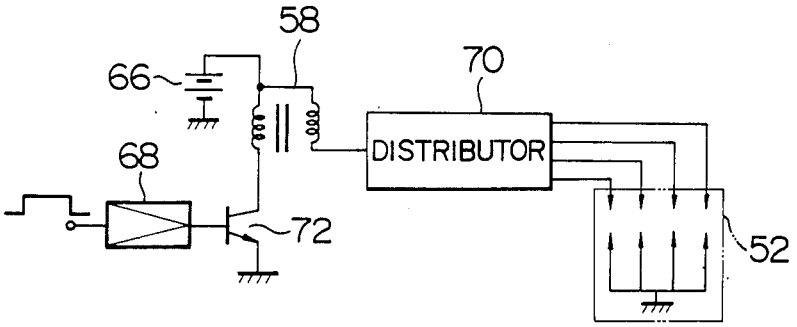
FIG. 2 is a schematic view of an ignition system of the arrangement of FIG. 1.

In FIG. 2, a pulse current is supplied to a power transistor 72 through an amplifier 68 to energize this transistor 72 so that a primary coil pulse current flows into an ignition coil 58 from a battery 66. At the trailing edge of this pulse current, the transistor 74 is turned off so as to generate a high voltage at the secondary coil of the ignition coil 58.

This high voltage is distributed through a distributor 70 to the ignition plugs 52 provided at the respective cylinders in the engine, in synchronism with the rotation of the engine.

Figure 3:
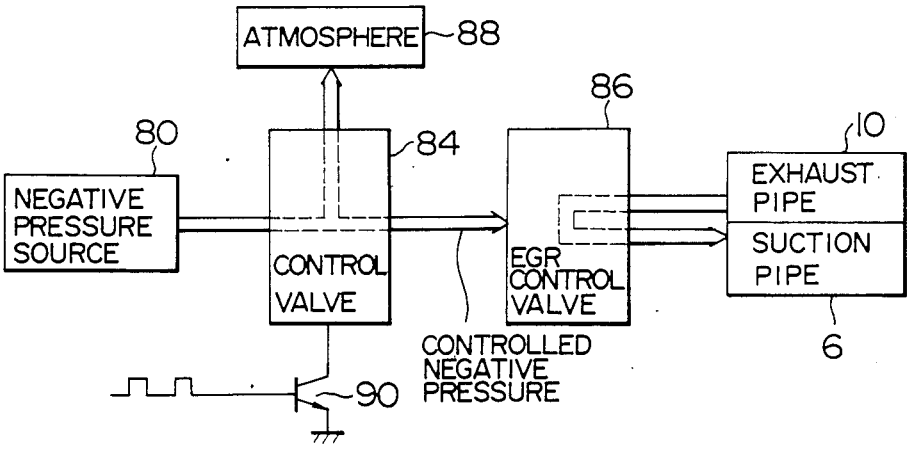
FIG. 3 is a schematic view of an exhaust gas circulating reflux system (EGR)

In an exhaust gas reflux (EGR) system of FIG. 3, a predetermined negative pressure of a negative pressure source 80 is applied to an EGR control valve 86 through a pressure control valve 84. The pressure control valve 84 controls the ratio with which the predetermined negative pressure of the negative pressure source is released to the atmosphere 88, in response to the ON duty factor of the repetitive pulse applied to a transistor 90, so as to control the state of application of the negative pressure pulse to the EGR control valve 86. Accordingly, the negative pressure applied to the EGR control valve 86 is determined by the ON duty factor of the transistor 90 per se. The amount of EGR from the exhaust pipe 10 to the suction pipe 6 is controlled by the controlled negative pressure of the pressure control valve 84.

The control system of FIG. 4, includes a central processing unit (CPU) 102, a read only memory (ROM) 104, a random access memory (hereinafter abbreviated (RAM) 106, and an input/output (I/O) circuit 108. The CPU 102 operates input data from the I/O circuit 108 in accordance with various programs stored in the ROM 104 and returns the result of operation to the I/O circuit 108. Temporary data storage necessary for such an operation is performed by using the RAM 106. Exchange of various data among the CPU 102, the ROM 104, the RAM 106, and the I/O circuit 108 is performed through a bus line 110 constituted by a data bus, a control bus, and an address bus.

The I/O circuit 108 includes input means such as the above-mentioned first analog-to-digital converter ADCl), a second analog-to-digital converter ADC2), an angular signal processing circuit 126, and a discrete I/O circuit DIO) for inputting/outputting one bit information.

In the ADCl, the respective output signals of a battery voltage sensor VBS) 132, the above-mentioned cooling water temperature sensor TWS) 56, an atmosphere temperature sensor TAS) 112, a regulation voltage generator VRS) 114, the above-mentioned throttle opening sensor $\theta$THS) 116, and a $\lambda$ sensor $\lambda$S) 118 are applied to the above-mentioned multiplexer MPX) 120 which selects one of the respective input signals and inputs the selected signal to an analog-to-digital converter circuit (ADC) 122. The digital value of the output of the ADC 122 is stored in a register (REG) 124.

Output signals of the air flow rate sensor (AFS) 24 and a vacuum sensor (hereinafter abbreviated as VCS) 25 are inputted to the ADC2 in which the signals are applied to a multiplexer 127 and then A/D converted in an ADC 128 and set in a REG 130.

An angle sensor (ANGS) 146 produces a reference signal representing a reference crank angle (hereinafter abbreviated as REF), for example as a signal generated at an interval of 180 degrees of crank angle, and a position signal representing a small crank angle (POS), for example 1 (one) degree. The REF and POS are applied to the angular signal processing circuit 126 to be waveform-shaped therein.

The respective output signals of an idle switch 148 (IDLE-SW) 148, a top gear switch (TOP-SW) 150, and a starter switch 152 (START-SW) are inputted into the DIO.

Next, a circuit for outputting pulses in accordance with the result of operation of the CPU 102 and an object to be controlled will be described hereunder. An injector circuit (INJC) 134 is provided for converting the digital value of the result of operation into a pulse output. Accordingly, a pulse having a pulse width corresponding to the period of fuel injection is generated in the INJC 134 and applied to the injector 12 through an AND gate 136.

An ignition pulse generating circuit (IGNC) 138 includes a register (ADV) for setting ignition timing and another register (DWL) for setting initiating timing of the primary current conduction of the ignition coil 58 and these data are set by the CPU 102. The ignition pulse generating circuit 138 produces a pulse on the basis of the thus set data and supplies this pulse through an AND gate 140 to the amplifier 68 described in detail with respect to FIG. 2.

An EGR amount controlling pulse generating circuit (EGRC) 180 for controlling the transistor 90 which controls the EGR control valve 86 as shown in FIG. 3, has a register EGRD for setting a value representing the duty factor of the pulse and another register EGRP for setting a value representing the repetitive period of the pulse. The output pulse of the EGRC 154 is applied to the transistor 90 through an AND gate 156.

The one-bit I/O signals are controlled by the circuit DIO. The I/O signals include the respective output signals of the IDLE-SW 148, the TOP-SW 150 and the START-SW 152 as input signals, and include a pulse signal for controlling the fuel pump 32 as an output signal. The DIO includes a register DDR for determining whether a terminal be used as a data inputting one or a data outputting one, and another register DOUT for latching the output data.

A register (MOD) 160 is provided for holding commands instructing various internal states of the I/O circuit 108 and arranged such that, for example, all the AND gates 136, 140, 144, and 156 are turned on/off by setting a command into the NOD 160. The stoppage/-start of the respective outputs of the INJC 134, IGNC 138, and ISCC 142 can be thus controlled by setting a command into the MOD 160.

Figure 5:
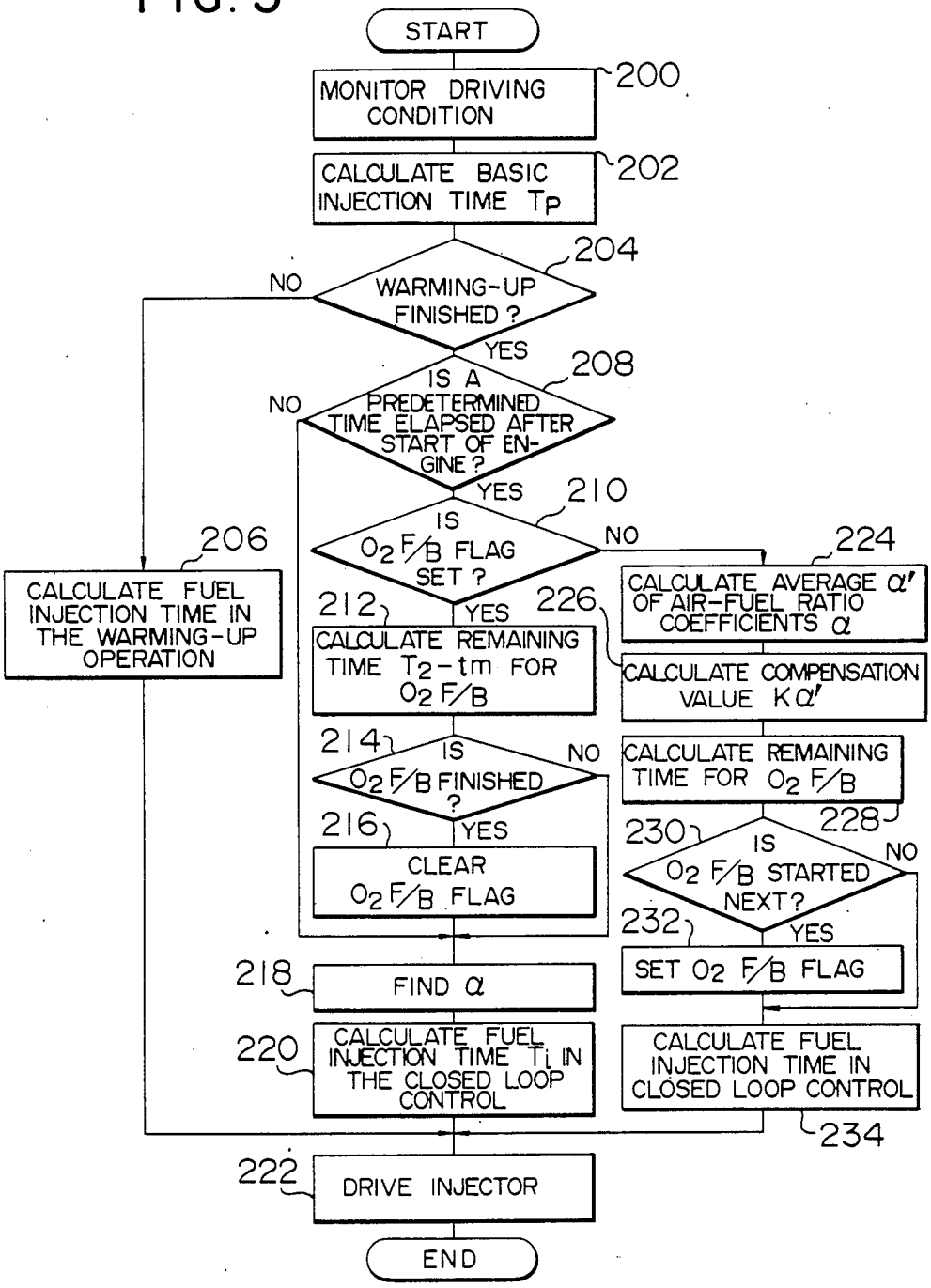
FIG. 5 is a flowchart of a first embodiment of the engine control method and apparatus of the invention.

In the embodiment of FIGS. 1–4, as shown in the flow chart of FIG. 5, an amount of fuel injection is determined by the closed loop control until a certain time elapses, after the warming-up driving, after start of the engine and then the closed loop control and the open loop control on the base of the oxygen concentration in the exhaust gas are alternately performed at intervals of a predetermined time. In this case, the duty ratio of the injection pulse to the fuel injector in the period of the open loop control is calculated on the basis of the average value of the duty ratio of the injection pulse in the period of the closed loop control.

First, at step 200 after the start of the engine, measured data indicative of driving conditions such as the revolution number per unit time of engine, cooling water temperature, magnitude of suction vacuum and amount of inlet air from various different sensors, the output from the λ-sensor etc. are received.

At step 202, an average air flow rate per one inlet stroke, $Q_A$ of a cylinder is determined on the basis of the output voltage from an air flow rate sensor 24 and a time (period) of basic fuel injection, $T_P$ corresponding to the amount of fuel injection per inlet stroke is calculated from:

$$T_P = K\frac{Q_A}{N} \quad (1)$$

where N is the revolution rate of engine and K is a coefficient depending on the charactersitics of the injector and so on.

At step 204, whether the engine is completely warmed up, or whether the warming-up driving should be stopped or not is decided on the basis of the measured data of the temperature of the colling water for the engine. If the decision is that the engine is already wardmed up, the program advances to step 208. If the decision is that the engine is not warmed up yet, the program goes to step 206, where the warming up operation is continued.

In the case of continuing the warming-up operation at step 206, a fuel injection time (period), Ti per inlet stroke upon warming-up is calculated from $$\mathrm{Ti} = T_P \alpha \cdot C_{oef} \quad (2)$$

where $T_P$ is the basic fuel injection time found at step 202, and $C_{oef}$ is the sum of different compensation factors such as an acceleration compensation factor $C_1$, a deceleration compensation factor $C_2$, a warming-up compensation factor $C_3$, etc. The warming-up compensation factor $C_3$ is a value determined on the basis of the cooling water temperature found at step 200, or it can be read from the map which is in a ROM 104 and shows the relation between the cooling water temperature and the coefficient $C_3$. In addition, $\alpha$ is the air-fuel ratio compensation factor determined on the basis of the air-fuel ratio control signal (see FIG. 6(*b*)) corresponding to the output voltage from the λ-sensor, or the compensation factor for making the current air-fuel ratio be a stoichiometric air-fuel ratio. Therefore, if the current air fuel ratio is a stoichiometric air-fuel ratio, the compensation coefficient $\alpha$ is 1. Upon warming-up, since the air-fuel ratio is not controlled by the feedback of the output of the λ-sensor, the compensation factor $\alpha$ is selected to be 1. The acceleration compensation factor and deceleration compensation factor are determined to be zero or a predetermined value by the decision of acceleration or deceleration condition at step 200.

At step 222, the digital data showing the fuel injection time Ti thus found is supplied to an injector control circuit 134, the output of which is then supplied as an injection pulse through an AND gate 136 to an injector 12.

At step 204, when decision is made of the fact that the warming-up operation has been completed, the program advances to step 208. At step 208, decision is made of whether a predetermined time $T_1$ has elapsed or not after the start of the engine. That is, after the warming-up operation ends, the closed loop control is made until the time $T_1$ elapses after the start of the engine. Therefore, when a start switch 152 for the engine is turned on, the first soft timer within the RAM 106 is set to zero and at the same time starts to count in response to the clock signal the lapse of time $t_l$ after the start of the engine. When the lapse of time $t_l$ is less than the predetermined time $T_1$, or $t_l < T_1$, the program goes to step 218, where the closed loop control is made on the basis of the λ-sensor output. When the lapse of time $t_l$ is equal to or larger than the predetermined time $T_1$, or $t_l \geqq T_1$, the program advances to step 210.

At step 218, the air-fuel ratio compensation factor $\alpha$ is found on the basis of the output of a λ-sensor 118 which was produced at step 200, and stored in a RAM. The coefficient $\alpha$ is an air-fuel ratio compensation factor determined on the output value from the λ-sensor 118 and which is used for correcting the current air-fuel ratio into the stoichiometric air-fuel ratio. Thus, when the current air-fuel ratio is detected by the λ sensor, to be a stoichiometric air-fuel ratio, the compensation factor $\alpha$ is equal 1. When the detected ratio is lean, $\alpha$ is larger than 1 and when it is rich, $\alpha$ is smaller than 1.

At step 220, the fuel injection time (period) Ti per inlet stroke is found from Eq. (2), where the basic injection time (period) Tp is a value found at step 202, the compensation factor $\alpha$ is a value found at step 218, and the warming up compensation factor $C_3$ of $C_{oef}$ is zero. Other compensation factors of $C_{oef}$ are determined by the operating condition of the engine which is detected at step 200.

Thus, at step 222 the injector 12 is controlled on the basis of the fuel injection time Ti calculated at step 220.

When the decision at step 208 is $t_l \geqq T_1$, the program advances to step 210, where decision is made of whether the $O_2$ feedback ($O_2F/B$) flag is set in the RAM 106, or whether the closed loop control or open loop control is made.

When at step 210 it is decided that the $O_2F/B$ flag is set in the RAM, the program advances to step 212, where $O_2$ feedback control (closed loop control) is executed. If it is decided that the $O_2F/B$ flag is reset, the program goes to step 224, where the closed loop control is made.

At step 212, the remaining time for the closed loop control is calculated. That is, after at step 208 it is decided that the predetermined time $T_1$ has elapsed after the start of the engine, the closed loop control and the open loop control are alternately made at every predetermined time. In other words, after the closed loop control is made during a predetermined time $T_2$, the open loop control is made during a certain time $T_3$. Therefore, the RAM 106 also includes a second soft timer for counting of time in the closed loop control and a third soft timer for counting of time in the open loop control. The second soft timer, when the closed loop control starts, is set to time $T_2$ and at the same time counts down from the time $T_2$ in response to the clock signal. Similarly, the third soft timer, when the closed loop control is started, is set to time $T_3$ and at the same time counts down from the time $T_3$ in response to the clock signal.

Therefore, at step 212, the count of time $(T_2-t_m)$ ($t_m$: the lapse of time from the start of the closed loop control) is read from the second soft timer.

Then, at step 214, decision is made of whether the count of time $(T_2-t_m)$ in the second timer is larger than zero or not, or whether the closed loop control is necessary to be finished or not. If $T_2=t_m>0$, or if it is decided that the closed loop control is to be continued, the program advances to step 218, while if $T_2\leqq 0$, or if it is decided to be finished, the program goes to step 216.

At step 216, the $O_2F/B$ flag is cleared, and the third soft timer is set to time $T_3$ and at the same time counts down from the time $T_3$ in response to the clock signal. After the process at step 216 has been finished, the program goes to step 218.

At steps 218 to 222, the fuel injection time Ti in the closed loop control is calculated and the injector is driven by the same way as described above. Each compensation factor of $C_{oef}$ is determined by the operating condition of the engine detected at step 200. Here, the warming-up compensation factor $C_3$ is zero.

When the closed loop control is continued for time $T_2$, and at step 210 the $O_2F/B$ flag is decided to be cleared, the program advances to step 224 where the closed loop control is started.

At step 224, the average of all the air-fuel ratio compensation coefficients $\alpha$ stored in the RAM during the closed loop control performed so far is calculated and the average value $\alpha'$ is set in the RAM. At the same time, all the air-fuel ratio compensation coefficients $\alpha$ stored in the RAM are cleared.

At step 226, the average value $\alpha'$ found at step 224 is multiplied by a closed loop compensation factor k to produce a corrected value k $\alpha'$ of the air-fuel ratio compensation factor, which is set in the RAM, where k is a positive value equal to or less than 1, preferably, $1.0>k>0.8$. The less the value of k, the larger the air-fuel ratio, or the ratio becomes lean.

At step 228, the remaining time for the closed loop control is calculated. That is, the content of the third soft timer $(T_3-t_n)$ ($t_n$: the time lapse from the start of the open loop control) is read.

At step 230, decision is made of whether the content $(T_3-t_n)$ of the third soft timer is larger than zero or not, or whether the open loop control should be terminated or not.

If $T_3-t_n>0$, it is decided that the open loop control is continued, and the program goes to step 234. If $T_3-t_n\leqq 0$, it is decided that the open loop control is terminated, and the program goes to step 232.

At step 232, the $O_2F/B$ flag is set, and as soon as the time $T_2$ is set in the second soft timer, the timer starts to count down from the set time $T_2$ in response to the clock signal. In addition, the average value $\alpha'$ calculated and stored in the RAM at step 224 is cleared.

After step 232, the program advances to step 234.

At step 234, the fuel injection time (period) Ti' per inlet stroke is calculated by substituting the basic injection time Tp found at step 202 and the compensation value k $\alpha'$ found at step 226 into Eq. (3) given below:

$$Ti'=Tp\cdot k\ \alpha' C_{oef} \tag{3}$$

where each compensation factor of $C_{oef}$ is determined by the operating condition of the engine detected at step 200. The warming-up correction coefficient $C_3$ is zero.

At step 222, the injector is driven on the basis of the fuel injection time Ti' thus determined. The fuel injection time during the following closed loop control is fixed to Ti'. The fuel injection time Ti' during the open loop control is shorter than the fuel injection time Ti during the closed-loop control by a value determined by the compensation factor k.

When the open-loop control is continued after completion of the above steps, the value k $\alpha'$ calculated and stored in the RAM is simply read at steps 224 and 226 and used for the calculation of Ti' at step 234.

Thus, after completion of open loop control, the $O_2F/B$ flag is set, and hence the closed loop control is made.

Figure 7:
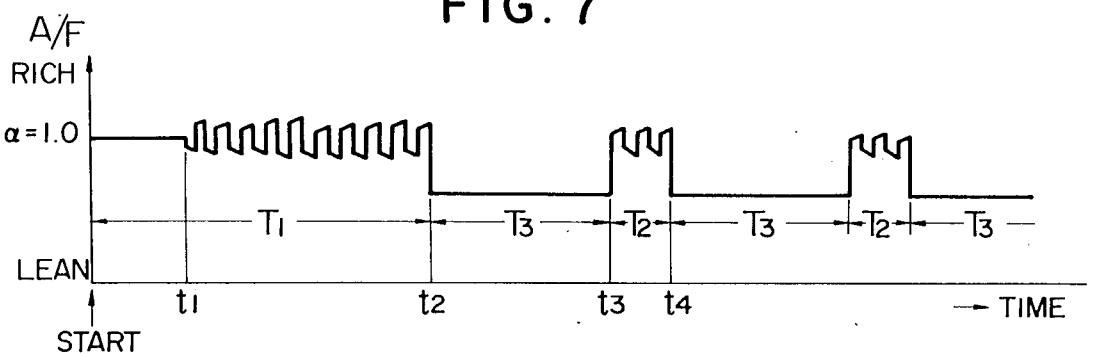
FIG. 7 is a timing chart of a controlled condition of an air-fuel ratio compensation factor in the first embodiment of the present invention.

The sequence of the fuel injection control after start of engine will be described with reference to FIG. 7.

First, warming-up operation is performed after start of engine, and during this operation the air-fuel ratio compensation factor $\alpha$ is kept 1. After the warming-up operation ends at time $t_1$, the closed loop control is performed, and the compensation factor $\alpha$ changes with the output voltage from the $\lambda$ sensor. This closed-loop control is continued until the predetermined time (period) $T_1$ elapses after the start. When the time $T_1$ has elapsed, the open-loop control is performed for the predetermined time (period) $T_3$. This open-loop control is made by deciding at step 210 in FIG. 5 that at time $t_2$ the $O_2F/B$ flag is not set, and carrying out the operations at steps 224 to 234. The compensation factor $\alpha$ in this open-loop control is k $\alpha'$ and smaller than the average compensation value $\alpha'$ in the closed-loop control during the time from $t_1$ to $t_2$. Therefore, the air-fuel ratio in the open loop control becomes lean.

After the open-loop control is made for time $T_3$, the closed-loop control is performed for the predetermined time $T_2$ between time $t_3$ and $t_4$. Then, the open loop control is made, in which case the air-fuel ratio compensation factor $\alpha$ is the average value $\alpha'$ (the air-fuel ratio compensation factor in the closed-loop control during the time between $t_3$ and $t_4$) multiplied by coefficient k, or k $\alpha'$.

The closed-loop control performed the predetermined time $T_1$ after the start is for finding the average value of the air-fuel ratio compensation factors $\alpha$ during the interval. Thus, the time $T_2$ for the closed loop control may be shorter than the time $T_3$ for the open loop control. When the warming-up condition is already completed at the start of engine, the closed loop control is continued from the start of engine to the lapse of time $T_1$.

In this embodiment, the open-loop control and the closed-loop control are alternately performed, and in the open loop control the fuel consumption rate for making the air-fuel ratio lean can be greatly improved.

In addition, the air-fuel ratio compensation factor in the open loop control is determined on the basis of the average value $\alpha'$ of the air-fuel compensation factors in the closed loop control previously performed. Therefore, even although the characteristics of the engine fuel supply system undergo secular variation, the air-fuel ratio compensation factor k $\alpha'$ in the closed loop control is always kept to be a proper value.

Moreover, even if the characteristics of the fuel supply system are scattered for respective engines, the compensation factor k $\alpha'$ suitable for the characteristics of the engine can be automatically obtained and hence it is not necessary to previously determine the compensation factor $\alpha$ for each engine.

Figure 8:
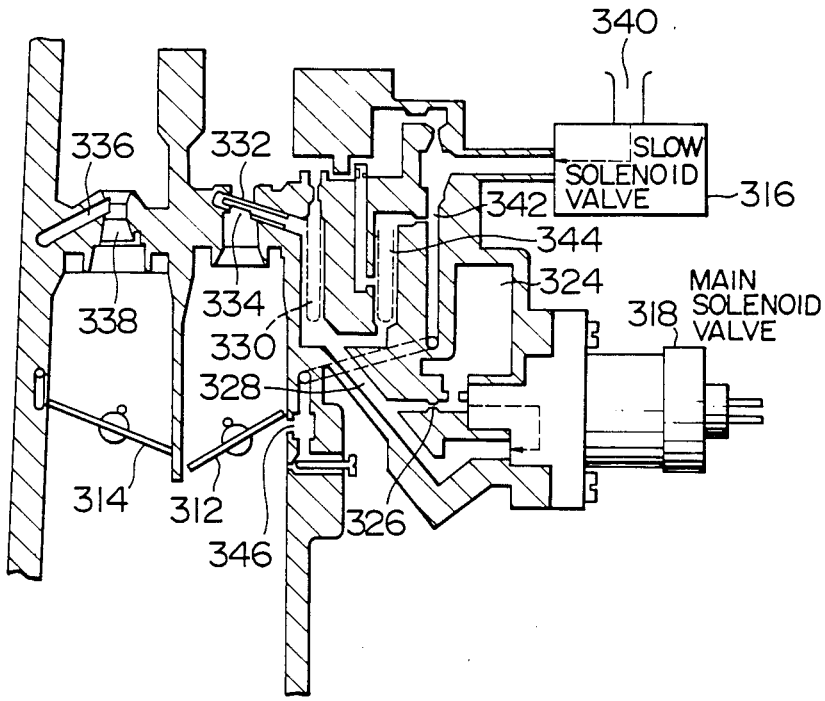
FIG. 8 is a partial cross-sectional view of a throttle chamber of an electronically controlled carburetor system engine.
Figure 9:
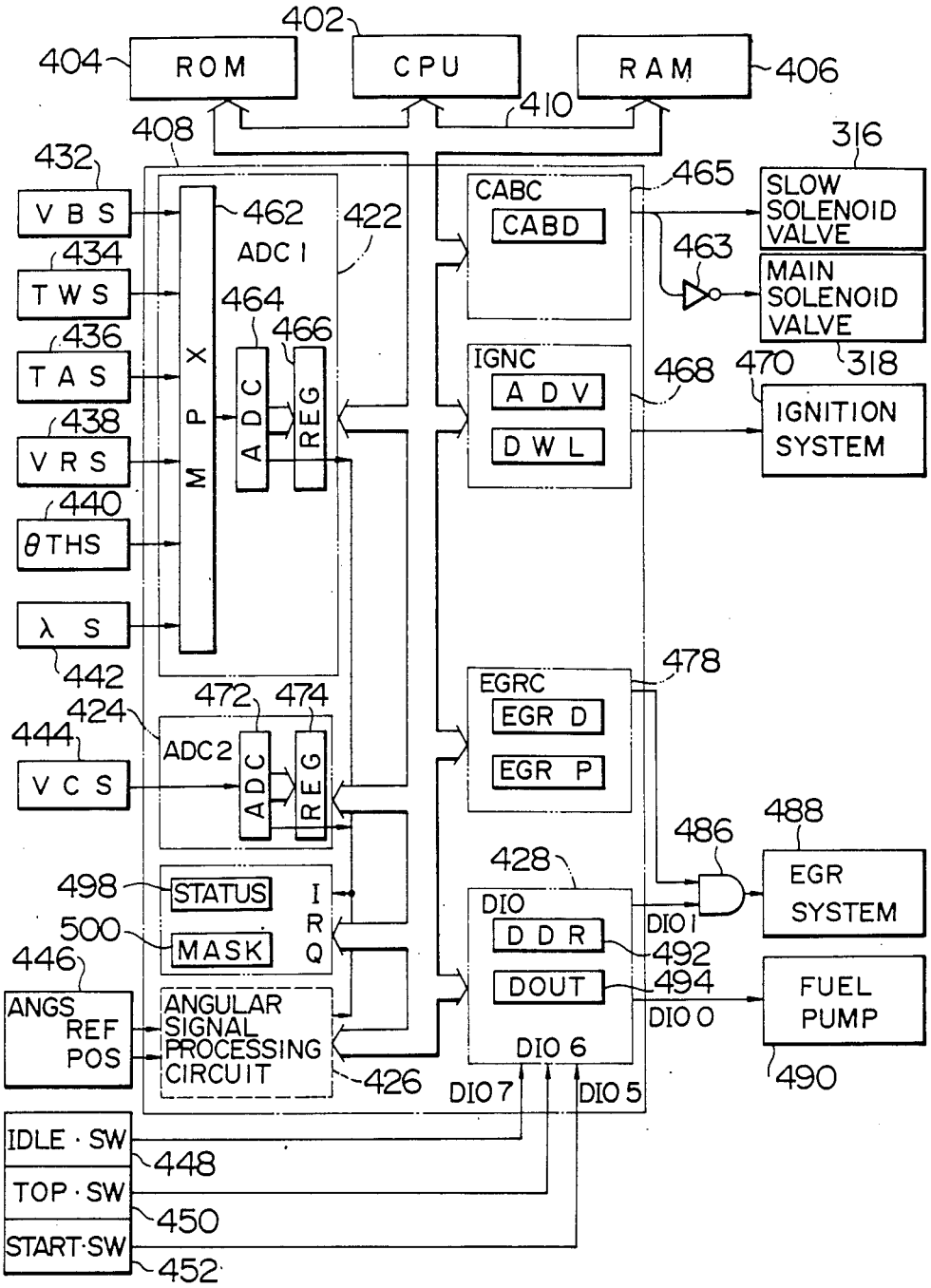
FIG. 9 is a schematic of an engine control system for an electronically controlled carburetor system.

In FIGS. 8 and 9, another embodiment of an air-fuel ratio controlling method of the invention is described as applied to an electronically controlled carburetor system and, as shown in FIG. 8, various solenoid valves 316, 318, 322 are provided around the throttle chamber for controlling a fuel quantity and a bypass air flow supplied to the throttle chamber, as will be described more fully hereinbelow.

Opening of a throttle valve 312 for a low speed operation is controlled by an acceleration pedal (not shown), whereby air flow supplied to individual cylinders of the engine from an air cleaner (not shown) is controlled. When the air flow passing through a Venturi 334 for the low speed operation is increased as the result of the increased opening of the throttle valve 312, a throttle valve 314 for a high speed operation is opened through a diaphragm device (not shown) in dependence on a negative pressure produced at the Venturi for the low speed operation, resulting in a decreased air flow resistance which would otherwise be increased due to the increased intake air flow.

The quantity of air flow fed to the engine cylinders under the control of the throttle valves 312 and 314 is detected by a negative pressure sensor (not shown) and converted into a corresponding analog signal. In dependence on the analog signal thus produced as well as other signals available from other sensors which will be described hereinafter, the opening degrees of the various solenoid valves 316, 318 and 322 shown in FIG. 8 are controlled.

To control the fuel supply, the fuel, fed from a fuel tank though a conduit 324, is introduced into a conduit 328 through a main jet orifice 326. Additionally, fuel is introduced to the conduit 328 through a main solenoid valve 318. Consequently, the fuel quantity fed to the conduit 328 is increased as the opening degree of the main solenoid valve 318 is increased. Fuel is then fed to a main emulsion tube 330 to be mixed with air and supplied to the Venturi 334 through a main nozzle 332. At the time when the throttle valve 314 for high speed operation is opened, fuel is additionally fed to a Venturi 338 through a nozzle 336. On the other hand, a slow solenoid valve (or idle solenoid valve) 316 is controlled simultaneously with the main solenoid valve 318, whereby air supplied from the air cleaner is introduced into a conduit 342, through an inlet port 340. Fuel fed to the conduit 328 is also supplied to the conduit or passage 342 through a slow emulsion tube 344. Consequently, the quantity of fuel supplied to the conduit 342 is decreased as the quantity of air supplied through the slow solenoid valve 316 is increased. The mixture of air and fuel produced in the conduit 342 is then supplied to the throttle chamber through an opening 346 which is also referred to as the slow hole. The slow solenoid valve 316 cooperates with the main solenoid valve 318 to control the fuel-air ratio. As shown in FIG. 9, control system for the carburetor system of FIG. 8 includes a central processing unit (CPU) 402, a read-only memory (ROM) 404, a random access memory (RAM) 406, and an input/output interface circuit 408. The CPU 402 performs arithmetic operations for input data from the input/output circuit 408 in accordance with various programs stored in ROM 404 and feeds the results of arithmetic operation back to the input/output circuit 408. Temporal data storage as required for executing the arithmetic operations is accomplished by using the RAM 406. Various data transfers or exchanges among the CPU 402, ROM 404, RAM 406 and the input/output circuit 408 are realized through a bus line 410 composed of a data bus, a control bus and an address bus.

The input/output interface circuit 408 includes input means constituted by a first analog-to-digital converter (ADC1) 422, a second analog-to-digital converter (ADC2) 424, an angular signal processing circuit 426, and a discrete input/output circuit (DIO) 428, for inputting or outputting a single-bit information.

The ADC1 422 includes a multiplexer (MPX) 462 which has input terminals applied with output signals from a battery voltage detecting sensor (VBS), 432, a sensor 434 for detecting temperature of cooling water (TWS), an ambient temperature sensor (TAS) 436, a regulated-voltage generator (VRS) 438, a sensor ($\theta$THS) 440 for detecting a throttle angle and a $\lambda$-sensor ($\lambda$S) 442. The multiplexer or MPX 462 selects one of the input signals to supply it to an analog-to-digital converter circuit (ADC) 464. A digital signal output from the ADC 464 is held by a register (REG) 466.

The output signal from a negative pressure sensor (VCS) 444 is supplied to the input of ADC2 424 to be converted into a digital signal through an analog-to-digital converter circuit (ADC) 472. The digital signal output from the ADC 472 is set in a register (REG) 474.

An angle sensor (ANGS) 446 is adapted to produce a signal REF representative of a standard or reference crank angle, e.g. of 180° and a signal POS representative of a minute crank angle (e.g. 0.5°). Both of the signals REF and POS are applied to the angular signal processing circuit 426 to be shaped.

The discrete input/output circuit or DIO 428 has inputs connected to an idle switch (IDLE-SW) 448, a top-gear switch (TOP-SW) 450 and a starter switch (START-SW) 452.

Next, description will be made on a pulse output circuit as well as objects or functions to be controlled on the basis of the results of arithmetic operations executed by CPU 402. A fuel-air ratio control device (CABC) 465 serves to vary the duty cycle of a pulse signal supplied to the slow solenoid valve 316 and the main solenoid valve 318 for the control thereof. Since increasing in the duty cycle of the pulse signal through control by CABC 465 has to involve decreasing in the fuel supply quantity through the main solenoid valve 318, the output signal from CABC is applied to the main solenoid valve 318 through an inverter 463. On the other hand, the fuel supply quantity controlled through the slow solenoid valve 316 is increased, as the duty cycle of the pulse signal produced from the CABC 465 is increased. The CABC 465 includes a register (CABD) for setting therein the duty cycle of the pulse signal. Data for the duty cycle to be loaded in the register CABD is available from the CPU 402.

An ignition pulse generator circuit (IGNC) 468 is provided with a register (ADV) for setting therein ignition timing data and a register (DWL) for controlling a duration of the primary current flowing through the ignition coil. Data for these controls are available from the CPU 402. The output pulse from the IGNC 468 is applied to the ignition system denoted by 470 in FIG. 9. The ignition system 470 is implemented in such arrangement as described hereinbefore in connection with FIG. 2. Accordingly, the output pulse from the IGNC 468 is applied to the input of the amplifier circuit 68 shown in FIG. 2.

A pulse generator circuit (EGRC) 478 for producing a pulse signal to control the quantity of exhaust gas to be recirculated (EGR) includes a register (EGRP) for setting the pulse repetition period and a register (EGRD) for setting the duty cycle of the pulse signal.

When the output signal DIO1 from the DIO 428 is at a level "H", an AND gate 486 is made conductive to control the EGR system 488, a fundamental construction of which is illustrated in FIG. 3.

The DIO 428 is an input/output circuit for a single bit signal as described hereinbefore and includes to this end a register (DDR) 492 for holding data to determine the output or input operation, and a register (DOUT) 494 for holding data to be output. The DIO 428 produces an output signal DI00 for controlling the fuel pump 490.

The second embodiment of an air-fuel ratio control method of the invention in the engine control system using an electronically controlled carburetor will be described with reference to FIGS. 8 and 9.

In the embodiment of FIGS. 8 and 9, after the end of the warming-up operation, the duty ratio of each of the main and slow solenoid valves is determined on the closed loop control until a constant time $T_1$ elapses after start of engine, and then the open loop control and the closed loop control are alternately performed at every predetermined time as in the first embodiment. In the closed loop control, the map in the RAM which is used for determining the duty ratio is always updated by the output from the λ sensor, and the duty ratio in the open loop control is determined by the new map.

Figure 10:
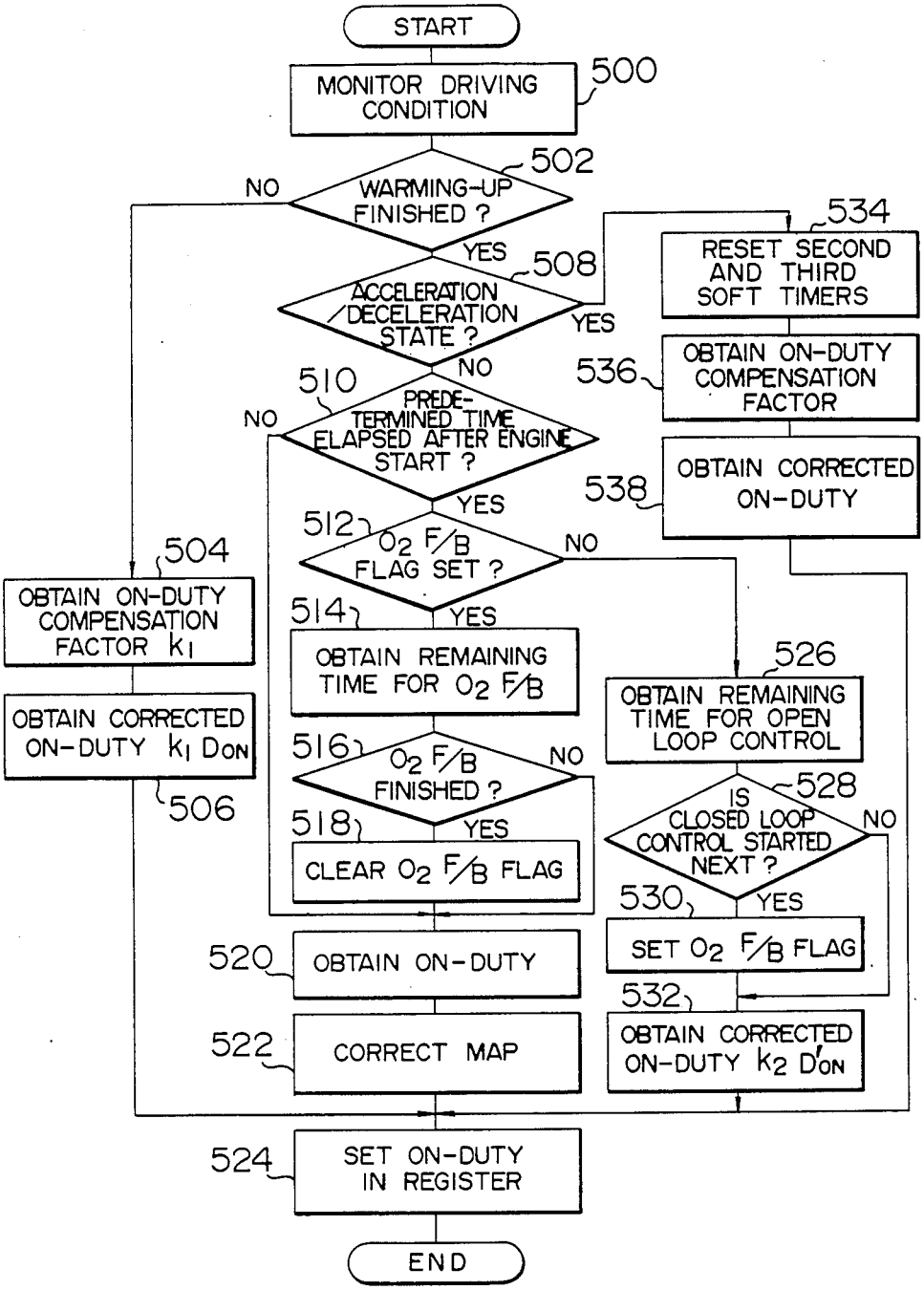
FIG. 10 is a flowchart of a second embodiment of the invention.

As shown in FIG. 10, first at step 500 after start of engine, the various different sensors supply measured data showing driving conditions such as the revolution rate of the engine, magnitude of suction vacuum, cooling water temperature, output of λ sensor, the condition of the throttle valve, etc.

At step 502, decision is made of whether the engine is being warmed up or not, from the measured data of the cooling water temperature. If it is decided that the engine has been warmed up, the program goes to step 508. If it is decided that the engine has not been warmed up yet, the program advances to step 504, where the warming-up operation is continued.

When the warming-up operation is continued, at step 504 the compensation factor $k_1$ for the duty ratio which is based on the cooling water temperature is read from the map stored in a RAM 406 as shown in FIG. 11. The data of the compensation factor shown in FIG. 11 is an example.

At step 506, the on-duty $D_{ON}'$ of a slow solenoid valve 316 is read from the three-dimensional map stored in the RAM shown in FIG. 12 on the basis of the revolution number per unit time N and the magnitude of suction vacuum Vc measured at step 500, and the read value is compensated by the compensation factor $k_1$. The map of FIG. 12 shows the on-duty values of the slow solenoid valve 316 which are determined by the revolution number N of engine and magnitude of suction vacuum Vc and make the air-fuel ratio be stoichiometric air-fuel ratio. These values are data previously set in accordance with the type of the engine. Thus, at step 506, corrected on-duty $k_1 \cdot D_{ON}$ is obtained.

At step 524, the corrected on-duty data are set in a register CABD, and a pulse of the set on-duty is supplied to the slow solenoid valve 316, and also through an inverter 463 to a main solenoid valve 318. The frequency of this pulse signal is constant.

If, at step 502, it is decided that the warming-up operation has been completed, the program goes to step 508, where decision is made of whether the driving operation is in a normal operating state or an acceleating/decelerating state.

The accelerating condition is decided by the rate of change of the amount of suction vacuum. That is, the difference between the amount of suction vacuum Vc detected at step 500 and the previously detected magnitude of suction vacuum Vc', or $\Delta Vc = Vc - Vc'$ is found, and then if the ΔVc is larger than a certain value, the driving condition is decided to be accelerating.

As to the decelerating condition, if the magnitude of suction vacuum detected at step 500 and the revolution number N of engine are each larger than a predetermined value, and if the throttle valve is completely closed, or an idle switch 448 is turned on, the driving condition is decided to be decelerating. Therefore, if, at step 508, the driving condition is decided to be accelerating or decelerating, the program goes to step 534. If the driving condition is decided not to be accelerating or decelerating, or if it is decided to be stationary (steady operating state), the program advances to step 510.

At step 510, decision is made of whether the predetermined time $T_1$ has elapsed or not after start of engine. In other words, the value $t_l$ is read from the first soft timer in the RAM which counts the time lapse after start of engine, and decision is made of whether or not the time $T_1$ is larger than the value $t_l$, that is, $T_1 \leqq t_l$. Therefore, if the time lapse $t_l$ is less than the predetermined value $T_1$ or $t_l < T_l$, the program advances to step 520, where the closed loop control is performed. If $t_l \geqq T_l$, the program goes to step 512.

Figure 6:
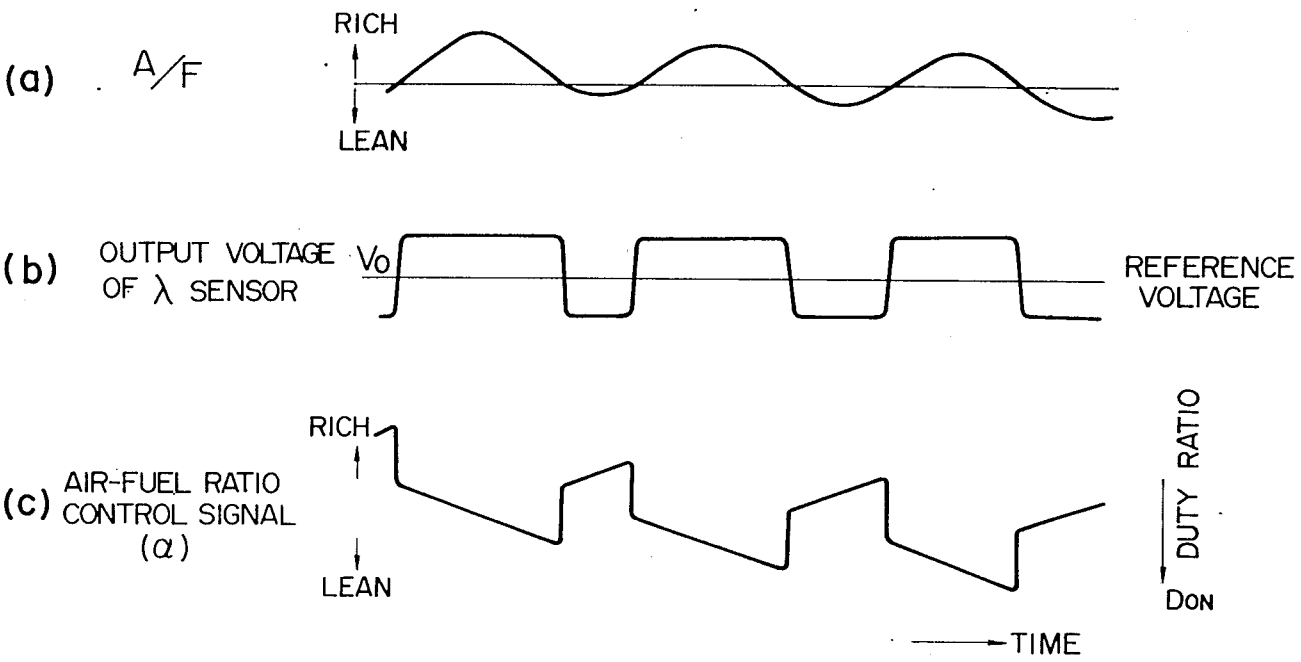
FIG. 6 is a timing chart of a relationship between an output signal from a λ-sensor and an air-fuel ratio control signal.

At step 520, the on-duty $D_{ON}$ is read which is determined on the basis of an air-fuel ratio control signal (FIG. 6(*c*)) which is obtained in accordance with the output signal (FIG. 6(*b*)) from the λ sensor 442 which was read at step 500. The on-duty value, as shown in FIG. 6(*c*), increases when the detected air-fuel ratio is rich, but decreases when it is lean. This on-duty value is a correct value for making the air-fuel ratio in the fuel system and suction system of the engine be a stoichiometric air-fuel ratio.

At step 522, the on-duty $D_{ON}$, obtained at step 520, is compared with the on-dut $D_{ON}'$ read from the map of FIG. 12 on the basis of the revolution rate of engine, N and magnitude of suction vacuum Vc, so as to produce the difference $\Delta D_{ON}=D_{ON}-D_{ON}'$. This difference is an error of the on-duty data of the map relative to the correct on-duty for making the air-fuel ratio be a stoichiometric air-fuel ratio. This error is caused by the scattering of the characteristics of the fuel system and suction system of engines and by the secular variation of the characteristics.

Therefore, the data of the map in the RAM shown in FIG. 12 is corrected on the basis of the difference $\Delta D_{ON}$. As an example of the correction, the difference $\Delta D_{ON}$ is added to the duty data of all map, thereby producing a new corrected map.

It is also possible to set the error $\Delta D_{ON}$ of on-duty in the RAM and correct the data read from the map by the error $\Delta D_{ON}$ into correct on-duty. Upon each execution of steps 520 and 522, the data of the on-duty map are updated.

At step 524, the on-duty $D_{ON}$ obtained at step 520 is set in the register CABD, and the pulse signal is supplied to the main and slow solenoid valves 316 and 318.

At step 510, if it is decided that a predetermined time has elapsed after start of engine, or $t_l \geqq T_1$, the program goes to step 512. At step 512, decision is made of whether the $O_2F/B$ flag is set in the RAM, or whether the closed- or open-loop control is performed. If it is decided that the $O_2F/B$ flag is set in the RAM, the program advances to step 514, where the closed loop control is made. If it is decided that the $O_2F/B$ flag is reset, the program goes to step 526, where the open loop control is made.

At step 514, the remaining time for the closed loop control is calculated. That is, reading is made of the contents of the second timer which counts the time for the closed loop control. When the closed loop control is started, the second soft timer is set at predetermined time $T_2$ during which the closed loop control is performed, and at the same time, this timer counts down from the time $T_2$ in response to the clock signal. Thus, the contents $(T_2-t_m)$ of the second soft timer show the remaining time for the closed loop control ($t_m$: the time lapse from the start of the closed loop control). Consequently, the contents $(T_2-t_m)$ are read, and at step 516, decision is made of whether the remaining time $(T_2-t_m)$ is larger than zero or not, or whether the closed loop control should be terminated or not. If $T_2-t_m>$, it is decided that the closed loop control should be continued, and the program advances to step 520. If $T_2-t_m \leqq 0$, it is decided that the closed loop control should be terminated, and the program goes to step 518.

At step 518, the $O_2F/B$ flag is cleared, and the third soft timer in the RAM is set at predetermined time $T_3$ during which the open loop control is made, and at the same time this timer starts to count down from the set time $T_3$ in response to the clock signal.

After step 518, the program advances to step 520.

At steps 520 to 524, as described above, the on-duty $D_{ON}$ is found on the basis of the output from λ sensor and the map is corrected on the difference $\Delta D_{ON}$ between the on-duty $D_{ON}$ and the on-duty $D_{ON}'$ read from the map. In addition, the duty pulse signal based on the on-duty $D_{ON}$ is supplied to the solenoid valves 316 and 318.

Thus, when the closed loop control is continued for the time $T_2$, at step 518 the $O_2F/B$ flag is cleared, and hence at 512 it is decided that the open loop control should be performed. Then, the program goes to step 526.

At step 526, reading is made of the contents $(T_3-t_n)$ of the third soft timer ($t_n$: the time lapse from the start of the closed loop control), or the remaining time for the open loop control is read.

At step 528, decision is made of whether the contents $(T_3-t_n)$ of the third soft timer is larger than zero or not, or whether the open loop control should be terminated or not.

If $T_3-t_n>0$, it is decided that the open loop control should be continued, and the program goes to step 532. If $T_3-t_n \leqq 0$, it is decided that the open loop control should be terminated, and the program advances to step 530.

At step 530, the $O_2F/B$ flag is set in the RAM, and the second soft timer is set at time $T_2$ and at the same time, starts to count down from the set time $T_3$ in response to the clock signal. After the step 530, the program goes to step 532.

At step 532, the on-duty $D_{ON}'$ is read from the map in the RAM on the basis of the revolution number $N_1$ of engine and magnitude of suction vacuum Vc detected at step 500. Also, the on-duty $D_{ON}'$ is multiplied by the open loop compensation factor $k_2$ to produce the corrected on-duty value $k_2 D_{ON}'$, where the compensation factor $k_2$ is positive and larger than 1.0, or preferably, $3>k_2>1$. The air-fuel ratio becomes lean when $k_2$ is a large value.

At step 524, the on-duty compensation value $k_2 D_{ON}'$ is set in the register CABD and the pulse signal is supplied to the main and slow solenoid valves 316, 318.

After the open loop control has been completed, the $O_2F/B$ flag is set and hence the closed loop control is started.

If at step 508 it is decided that the driving condition of the engine is accelerating or decelerating, the program advances to step 534, where the contents of third soft timer are reset and the second soft timer is set at time $T_2$ and at the same time, starts to count down from the set value $T_2$ in response to the clock signal. This is because the closed loop control is again continued for the predetermined time after the accelerating or decelerating condition has terminated.

At step 536, the on-duty compensation factor corresponding to the degree of the acceleration or deceleration is read from the map of the RAM.

First, description is made of the case where at step 536 the driving condition is decided to be accelerating. In the RAM are stored values of acceleration on-duty compensation factor $C_a$ for the rate of change ΔVc of the magnitude of suction vacuum Vc found at step 508, in the form of a secondary map. The value of the coefficient $C_a$ is positive and smaller than 1.0. As the rate of change of the magnitude of suction vacuum is increased, this compensation factor decreases, or the air-fuel ratio becomes rich. Therefore, if at step 508 the driving state is decided to be accelerating, the coefficient $C_a$ is read from the map of the rate of change ΔVc of the magnitude of suction vacuum found at step 508.

On the other hand, in the RAM is stored a three-dimensional map of deceleration on-duty compensation factor $C_d$ for the magnitude of suction vacuum, Vc and the revolution number of engine, N as shown in FIG. 13. The value of the coefficient $C_d$ is positive and larger than 1.0. As the revolution rate of engine, N increases or as the magnitude of suction vacuum Vc increases, the coefficient value increases, or the air-fuel ratio becomes lean. Therefore, if at step 508 it is decided that the driving condition is decelerating, the compensation factor $C_d$ corresponding to the magnitude of suction vacuum, Vc and the revolution number of engine, N is read from the map of FIG. 13.

At step 538, the compensation factor $C_a$ or $C_d$ read at step 534 is multiplied by the on-duty $D_{ON}'$ read on the basis of the revolution number, N and the magnitude of suction vacuum Vc from the map of on-duty, to produce the on-duty compensation value $C_a$ $D_{ON}'$ or $C_d$ $D_{ON}'$ for acceleration or deceleration. Then, at step 524, the on-duty compensation value $C_a$ $D_{ON}'$ or $C_d$ $D_{ON}'$ is set in the register CABD.

Figure 14:
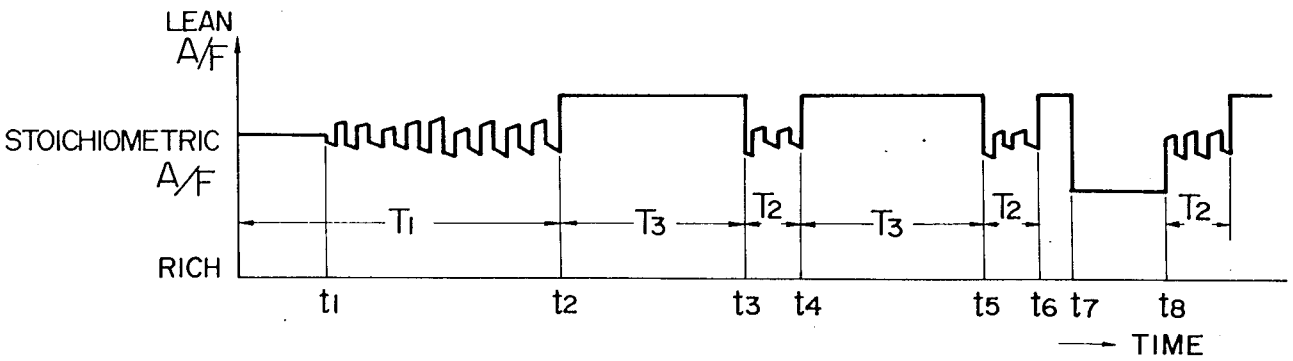
FIG. 14 is a timing chart of a controlled condition of the on-duty in the second embodiment.

A sequence of on-duty control operations after start of engine will be described with reference to FIG. 14.

First, warming-up operation is made after start of engine, and the on-duty during this operation is set at a value corresponding to the cooling water temperature. When the warming-up operation ends at time $t_1$, the closed loop control is performed, and the on-duty is determined on the output voltage from the λ-sensor. This closed loop control is continued until the predetermined time $T_1$ elapses after start of engine. After the time $T_1$ elapses, the open loop control is continued for the predetermined time $T_3$. The on-duty in the open loop control is the value $D_{ON}'$ read from the three-dimensional map corrected at the time of the closed loop control during the time between $t_1$ and $t_2$, multiplied by a constant open loop compensation factor k ($3.0>k>1.0$) and it is larger than the on-duty in the closed loop control. Thus, the air-fuel ratio in the open loop control becomes lean.

After the open loop control is continued for time $T_3$, the closed loop control is performed for the time $T_2$ between time $t_3$ and $t_4$. After the closed loop control is completed, the open-loop is again performed. At this time, the on-duty is obtained by multiplying the value $D_{ON}'$ read from the map corrected in the closed loop control during the time from $t_3$ to $t_4$, by the compensation factor $k_2$. In this way, after time $T_1$ elapses from the start of engine, usually the closed loop control and open loop control are alternately performed. In this case, the closed loop control to be performed after time $T_1$ elapses from the start of engine is for correcting the on-duty value of the three dimensional map of the RAM, and thus the time for which the closed loop control is performed may be much shorter than the time $T_3$ for which the open loop control is performed.

At the start of engine, when the completely warmed up condition is reached, the closed loop control is immediately started and continued for time $T_1$.

In the open loop control or closed loop control, when accelerating condition or decelerating condition is detected, steps 534 to 538 are immediately started to be executed in turn. When the steady state is again brought about, the closed loop control is performed during time $T_2$. That is, for example, in FIG. 14, when the driving condition is decided to be accelerating at time $t_7$, the open loop control is stopped, and steps 534 to 538 are executed to obtain the on-duty from the two-dimensional map.

When at time $t_8$ the driving condition is changed from the accelerating condition to the steady state the closed loop control is again started.

According to this emboidment, as in the first embodiment, the open loop control and closed loop control are alternately performed, and in the open loop control, the air-fuel ratio is selected to be lean, so that the fuel consumption rate can be greately improved.

Moreover, the on-duty in the open loop control is obtained on the basis of the three dimentional map corrected in the closed loop control. Therefore, even if the characteristics of the fuel supply system and suction system are scattered for respective engines or undergo secular variation, the on-duty in the open loop control is always maintained to be a proper value.

Further, the second embodiment is also applicable to another type of a carburetor system other than that shown in FIG. 8.

What is claimed:

1. In a method of controlling an air-fuel ratio for an engine having a plurality of first sensors for detecting an operating condition of the engine; a second sensor for detecting a condition of exhaust gas produced by the combustion of the fuel in a combustion chamber; arithmetic means for determining a control value for attaining a desired air-fuel ratio of a fuel-air mixture to be supplied to the combustion chamber of the basis of the outputs of the first sensors and the second sensor; a drive circuit for producing a control signal in response to the output of the arithmetic means; and air-fuel ratio control means for controlling an air-fuel ratio of the mixture in accordance with the output of the drive circuit;

said method comprising:

a first step of detecting the outputs of said first and second sensors;

a second step for determining a first control value for attaining such a first air-fuel ratio of the mixture that assures a desired air-fuel ratio in said combustion chamber, based on the outputs of said first and second sensors, and for applying data representing the determined first control value to said drive circuit;

a third step for determining a second control value for attaining a second air-fuel ratio of the mixture which is lean by a predetermined ratio than the first air-fuel ratio, and for applying data representing the second control value to said drive circuit, wherein said second step and third step are executed alternately in a manner that said first and second steps are repeated for a first predetermined period and thereafter said first and third steps are repeated for a second predetermined period;

wherein said arithmetic means determines a fuel injection period for one suction stroke of the combustion chamber as said first control value on the basis of said first and second sensors, said air-fuel ratio control means is fuel injection valve means for injecting fuel for the fuel injection period represented by the output of said drive circuit in response thereto, said second sensor is a λ sensor, said second step determines such a first basic fuel injection period on the basis of the output of said second sensor that assures a stoichiometric air-fuel ratio of the mixture in the combustion chamber, and corrects the first basic fuel injection period on the basis of the outputs of said second sensors, and apply data representing the corrected first basic fuel injection period as the first control value to said drive circuit, and said third step determines such a second basis fuel injection period on the basis of the outputs of said first sensors that assures an air-fuel ratio of the mixture to be lean by said predetermined ratio than said first air-fuel ratio, and corrects the second basis fuel injection period on the basis of output of said first sensors, and apply data representing the corrected second basic fuel injection period as the second control value to said drive circuit, said first predetermined period being shorter than said second predetermined period;

wherein said third step determines an average value of the first basic fuel injection periods obtained in said second steps performed in said first predetermined ratio; and wherein only said first and second steps are performed until a predetermined time elapses after the start of the engine, after the warming up operation of the engine ends.

2. An air-fuel ratio control apparatus for an engine comprising:

a plurality of first sensors for detecting an operating condition of the engine;

a second sensor for detecting a condition of exhaust gas produced by the combustion of the fuel in a combustion chamber;

arithmetic means for determining a control value for attaining a desired air-fuel ratio of a mixture to be supplied to the combustion chamber on the basis of the outputs of said first and second sensors;

a drive circuit for producing a control signal in response to the output of said arithmetic means; and air-fuel ratio control means for controlling an air-fuel ratio of the mixture in accordance with the output of said drive circuit;

wherein said arithmetic means performs selectively one of a closed-loop control and an open-loop control, said closed-loop control determining a first control value for attaining such a first air-fuel ratio of the mixture that assures a desired air-fuel ratio in said combustion chamber on the basis of the outputs of said first and second sensors and applying data representing the first control value to said drive circuit, said open-loop control determining a second control value for attaining a second air-fuel ratio of the mixture which is lean by a predetermined ratio than the first air-fuel ratio and applying data representing the second control value to said drive circuit;

wherein said closed-loop control is continued for a first predetermined period and said open-loop control is continued for a second predetermined period which is longer than said first predetermined period, in a manner that said open-loop control and closed-loop control are performed alternately;

wherein said arithmetic means determines a fuel injection period for one suction stroke of the combustion chamber as said first control value on the basis of said first and second sensors, said air-fuel ratio control means is fuel injection valve means for injection fuel for the first fuel injection period represented by the output of said drive circuit in response thereto, said second sensor is a λ sensor, said closed-loop control determines such a first basic fuel injection period on the basis of the output of said second sensor that assures a stoichiometric air-fuel ratio of the mixture in the combustion chamber, and corrects the first basic fuel injection period on the basis of the output of said second sensor, and apply data representing the corrected first basic fuel injection period as the first control value to said drive circuit, and said open-loop control determines such a second basic fuel injection period on the basis of the outputs of said first sensors that assures an air-fuel ratio of the mixture to be lean by said predetermined ratio than said first air-fuel ratio, and corrects the second basic fuel injection period on the basis of the output of said first sensors, and apply data representing the corrected second basic fuel injection period as the second control value to said drive circuit; and wherein said closed-loop control is performed until a predetermined time elapses after the start of the engine, after the warming up operation of the engine ends.

* * * * *